US008961292B2

(12) United States Patent
Burke et al.

(10) Patent No.: US 8,961,292 B2
(45) Date of Patent: Feb. 24, 2015

(54) SYSTEM FOR MANAGING WAGERING GAME CONTENT

(75) Inventors: Mary M. Burke, Somonauk, IL (US); Shridhar P. Joshi, Naperville, IL (US); Larry J. Pacey, Northbrook, IL (US); Matthew J. Ward, Northbrook, IL (US)

(73) Assignee: WMS Gaming, Inc., Waukegan, IL (US)

( * ) Notice: Subject to any disclaimer, the term of this patent is extended or adjusted under 35 U.S.C. 154(b) by 1193 days.

(21) Appl. No.: 12/527,504

(22) PCT Filed: Feb. 25, 2008

(86) PCT No.: PCT/US2008/054896

§ 371 (c)(1),
(2), (4) Date: Aug. 17, 2009

(87) PCT Pub. No.: WO2008/106404

PCT Pub. Date: Sep. 4, 2008

(65) Prior Publication Data

US 2010/0081509 A1 Apr. 1, 2010

Related U.S. Application Data

(60) Provisional application No. 60/892,038, filed on Feb. 28, 2007.

(51) Int. Cl.
*G07F 17/32* (2006.01)

(52) U.S. Cl.
CPC ..... *G07F 17/323* (2013.01)
USPC ..... 463/20; 463/16; 705/52

(58) Field of Classification Search
USPC ..... 463/23, 16
See application file for complete search history.

(56) References Cited

U.S. PATENT DOCUMENTS

| | | | | |
|---|---|---|---|---|
| 6,988,267 | B2 * | 1/2006 | Harris et al. | 717/173 |
| 7,125,335 | B2 * | 10/2006 | Rowe | 463/25 |
| 7,131,909 | B2 * | 11/2006 | Rowe | 463/42 |
| 7,168,089 | B2 * | 1/2007 | Nguyen et al. | 726/4 |
| 7,186,181 | B2 * | 3/2007 | Rowe | 463/42 |
| 7,338,372 | B2 * | 3/2008 | Morrow et al. | 463/31 |

(Continued)

FOREIGN PATENT DOCUMENTS

WO WO-2007011971 * 1/2007

OTHER PUBLICATIONS

"PCT Application No. PCT/US2008/054896 International Preliminary Report on Patentability", Aug. 13, 2009 , 14 pages.

(Continued)

*Primary Examiner* — Evens J Augustin
(74) *Attorney, Agent, or Firm* — DeLizio Gilliam, PLLC

(57) ABSTRACT

A system for managing wagering game content is described herein. In one embodiment, an apparatus includes a wagering game machine management server. The wagering game server can include a content controller configured to receive wagering game content and load the wagering game content onto a wagering game machine over the network. The wagering game server can also include a compatibility controller configured to determine whether the wagering game content is compatible with the wagering game machine. Additionally, the wagering game server can include a license controller configured to receive licensing information and to use the licensing information to activate the wagering game content.

20 Claims, 12 Drawing Sheets

(56) References Cited

U.S. PATENT DOCUMENTS

| | | | | |
|---|---|---|---|---|
| 7,341,522 | B2 * | 3/2008 | Yamagishi | 463/42 |
| 7,364,508 | B2 * | 4/2008 | Loose et al. | 463/30 |
| 7,374,488 | B2 * | 5/2008 | Schober et al. | 463/29 |
| 7,399,229 | B2 * | 7/2008 | Rowe | 463/42 |
| 7,464,256 | B2 * | 12/2008 | Muir | 713/1 |
| 7,515,718 | B2 * | 4/2009 | Nguyen et al. | 380/278 |
| 7,526,736 | B2 * | 4/2009 | Kaminkow et al. | 715/839 |
| 7,568,973 | B2 * | 8/2009 | Iddings et al. | 463/25 |
| 7,585,219 | B2 * | 9/2009 | Randall et al. | 463/20 |
| 7,585,223 | B2 * | 9/2009 | Iddings et al. | 463/27 |
| 7,674,180 | B2 * | 3/2010 | Graham et al. | 463/29 |
| 7,695,363 | B2 * | 4/2010 | Gilliland et al. | 463/20 |
| 7,699,699 | B2 * | 4/2010 | Gilliland et al. | 463/20 |
| 7,722,466 | B2 * | 5/2010 | Rothschild | 463/42 |
| 7,744,458 | B2 * | 6/2010 | Marks et al. | 463/20 |
| 7,766,747 | B2 * | 8/2010 | Bonney et al. | 463/35 |
| 7,780,523 | B2 * | 8/2010 | Baerlocher et al. | 463/26 |
| 7,785,191 | B2 * | 8/2010 | Marks et al. | 463/21 |
| 7,785,194 | B2 * | 8/2010 | Schneider et al. | 463/25 |
| 7,794,323 | B2 * | 9/2010 | Cannon | 463/29 |
| 7,798,901 | B2 * | 9/2010 | Nguyen et al. | 463/29 |
| 7,837,556 | B2 * | 11/2010 | Breckner et al. | 463/30 |
| 7,841,939 | B2 * | 11/2010 | Baerlocher et al. | 463/25 |
| 7,862,430 | B2 * | 1/2011 | Baerlocher et al. | 463/29 |
| 7,905,778 | B2 * | 3/2011 | Breckner et al. | 463/26 |
| 7,918,730 | B2 * | 4/2011 | Brosnan et al. | 463/32 |
| 7,918,735 | B2 * | 4/2011 | Inamura | 463/42 |
| 7,918,736 | B2 * | 4/2011 | Walker et al. | 463/42 |
| 7,927,210 | B2 * | 4/2011 | Blackburn et al. | 463/29 |
| 2002/0129052 | A1 * | 9/2002 | Glazer et al. | 707/501.1 |
| 2003/0064771 | A1 * | 4/2003 | Morrow et al. | 463/16 |
| 2003/0130039 | A1 * | 7/2003 | Nelson | 463/42 |
| 2004/0225688 | A1 * | 11/2004 | Thaler et al. | 707/200 |
| 2005/0043072 | A1 * | 2/2005 | Nelson | 463/1 |
| 2006/0035713 | A1 * | 2/2006 | Cockerille et al. | 463/42 |
| 2007/0004506 | A1 * | 1/2007 | Kinsley et al. | 463/29 |
| 2007/0060361 | A1 * | 3/2007 | Nguyen et al. | 463/42 |
| 2011/0087550 | A1 * | 4/2011 | Fordyce et al. | 705/14.65 |

OTHER PUBLICATIONS

"PCT Application No. PCT/US2008/054896 International Search Report", Jul. 11, 2008 , 10 pages.

* cited by examiner

SYSTEM FOR MANAGING WAGERING GAME CONTENT

RELATED APPLICATIONS

This application claims the priority benefit of U.S. Provisional Application Ser. No. 60/892,038 filed Feb. 28, 2007.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2008, WMS Gaming, Inc.

FIELD

Embodiments of the inventive subject matter relate generally to wagering game systems, and more particularly to systems for managing wagering game content.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

A method is described comprising detecting a selection of wagering game content and a wagering game machine; acquiring compatibility information associated with a wagering game machine; and determining, based at least in part on the compatibility information, whether the wagering game content is compatible with the wagering game machine.

In some embodiments, the method is further comprising generating a report indicating whether the wagering game content is compatible with the wagering game machine;

In some embodiments, the method is further comprising if the wagering game content is compatible with the wagering game machine, loading the wagering game content onto the wagering game machine over a network; and if the wagering game content is not compatible with the wagering game machine, reporting incompatibilities between the wagering game content and the wagering game machine.

In some embodiments, the compatibility information describes one or more components of the wagering game machine, the components selected from the group consisting of button panels, special buttons, audio devices, video devices, operating systems, CPU boards, DRAM, NVRAM, hard disk drives, and application software.

In some embodiments, the compatibility information is acquired from the wagering game machine over a network.

In some embodiments, the compatibility information is acquired from a database separate from the wagering game machine.

An apparatus is described comprising a wagering game machine management server including, a content controller configured to receive wagering game content and load the wagering game content onto a wagering game machine; a compatibility controller configured to determine whether the wagering game content is compatible with the wagering game machine; and a license controller configured to receive licensing information and to use the licensing information to activate the wagering game content.

In some embodiments, the content controller is configured to receive the wagering game content over a network.

In some embodiments, the license controller is configured to receive the licensing information over a network.

In some embodiments, the wagering game machine cannot use the wagering game content without the licensing information.

In some embodiments, the wagering game machine management server further includes a features controller configured to distribute gaming features to the wagering game machine over the network, wherein the gaming features allow configuration of the wagering game machine and the wagering game content.

In some embodiments, the gaming features allow configuration of one or more of attributes of the wagering game machine, wherein the attributes are selected from the group consisting of denominations, maximum bets, maximum paylines, number of wagering games, and payout percentage.

In some embodiments, the licensing information includes a license key including one or more selected from the group consisting of a part number, seat count, trial indicator, perpetual indicator, length of service, and not before date.

In some embodiments, the compatibility controller is configured to determine compatibility between the wagering game content and the wagering game as part of a process for loading the wagering game content onto the wagering game machine.

In some embodiments, the compatibility controller is configured to determine compatibility between the wagering game content and the wagering game separate from a process for loading the wagering game content onto the wagering game machine.

A wagering game machine is described comprising a network interface configured to facilitate communications over a network; a wagering game machine management client configured to control receipt of wagering game content and licensing information through the network interface and to initiate transmission of compatibility information through the network interface, wherein the compatibility information identifies components of the wagering game machine, and wherein the compatibility information is for use in a determination of whether the wagering game content is compatible with the wagering game machine; a wagering game unit configured to present wagering games based on the wagering game content and licensing information.

In some embodiments, the wagering game management client is further configured to receive gaming features, wherein the gaming features enable configuration of the wagering game content and the wagering game machine.

In some embodiments, the wagering game management client is further configured to receive gaming features, wherein the gaming features enable configuration of attributes of the wagering game machine, wherein the attributes include one or more selected from the group consisting of denominations, maximum bets, maximum paylines, number of wagering games, and payout percentage.

In some embodiments, the wagering game management client is further configured to receive gaming features, wherein the gaming features enable the wagering game machine to switch between a plurality of wagering games to change paylines, denominations, maximum bets, maximum paylines, number of wagering games, and payout percentage based on date and time.

In some embodiments, the licensing information includes one or more selected from the group consisting of a part number, seat count, trial indicator, perpetual indicator, length of service, and a not-before date.

A method is described comprising detecting a request to deploy wagering game content to one of a plurality of wagering game machines on a casino floor, wherein the wagering game content includes one or more features and denominations; accessing casino floor configuration rules indicating conditions for allowing deployment of the wagering game content to the wagering game machine; determining, based at least in part on the casino floor configuration rules and the one or more features and denominations, that the conditions for allowing deployment of the wagering game content have not been satisfied; and presenting graphics indicating that deployment of the wagering game content to the one of the plurality of wagering game machines is not allowable.

In some embodiments, the method is further comprising presenting a list of alternative wagering game content that the one of the plurality of wagering game machines.

In some embodiments, the method is further comprising blocking deployment of the wagering game content.

In some embodiments, the wagering game content includes a wagering game, and wherein the one or more features and denominations are associated with the wagering game.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into five sections. The first section provides an introduction, while the second section describes an example operating environment. The third section describes operations performed by some embodiments and the fourth section describes wagering game machines in more detail. The fifth section presents some general comments.

Introduction

Many casino operators update wagering game content by manually delivering new content to each wagering game machine. For example, when a machine's content becomes undesirable or a license expires, an operator may manually replace the machine's media (e.g. ROM, CD-ROM, or flash RAM) with new media containing updated wagering game and licensing content. Additionally, operators may need to configure (e.g., adjust the machine's DIP switches, jumpers, etc.) the machine to work with the new content. For gaming machine operators owning scores of machines, this process can be laborious and expensive. However, some embodiments of the inventive subject matter enable casino operators to automate content and license distribution and other related tasks. The following sections will describe these and other features of the inventive subject matter.

Operating Environment

This section describes an example operating environment and provides structural aspects of some embodiments. In particular, this section includes discussion about wagering game networks, wagering game network device architectures, wagering game content, licensing information, and more.

Wagering Game Networks

Figure 1:
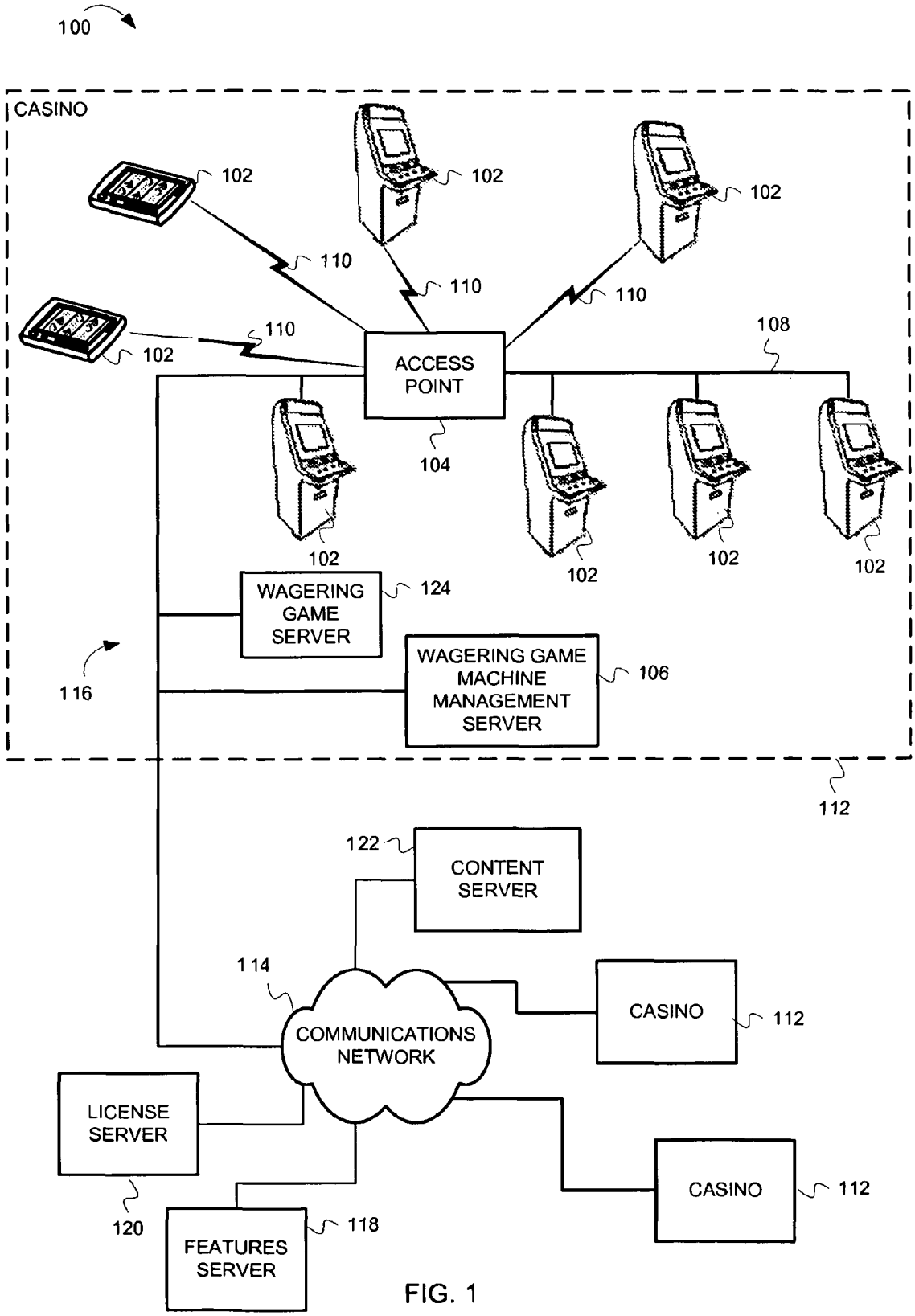
FIG. 1 is a block diagram illustrating a wagering game network 100, according to some embodiments of the invention

FIG. 1 is a block diagram illustrating a wagering game network 100, according to some embodiments of the invention. As shown in FIG. 1, the wagering game network 100 includes a communications network 114 connected to a features server 118, content server 122, license server 120, and a plurality of casinos 112. In some embodiments, the content server 122 can distribute wagering game content for use on wagering game machines, whereas the license server 120 can create and distribute license keys that limit use of the waging game content. The features server 118 can distribute features that augment the configurability of wagering game content and/or wagering game machines.

Each casino 112 includes a local area network 116 that includes a wagering game server 124, wagering game machine management server ("management server") 106, and wagering game machines 102. In some embodiments, the wagering game server 124 can serve wagering games to the wagering game machines 102 (see discussion below), while the management server 106 can perform various content management operations in automated fashion. For example, in some embodiments, the management server 106 can execute processes for distributing content, checking compatibility, managing features, tracking licenses, and more. In performing these processes, the management server 106 can receive wagering game content and compatibility information from the content server 122, license keys from the license server 120, and wagering game features from the feature server 118. Additional details about these processes and interactions are described in the next section.

Each casino also includes an access point 104 for providing wireless communication links 110 and wired communication links 108. The wired and wireless communication links can employ any suitable connection technology, such as Bluetooth, 802.11, Ethernet, public switched telephone networks, SONET, etc.

The wagering game machines 102 can take any suitable form, such as floor standing models, handheld mobile units, bartop models, workstation-type console models, etc. Further, the wagering game machines 102 can be primarily dedicated for use in conducting wagering games, or can include non-dedicated devices, such as mobile phones, personal digital assistants, personal computers, etc.

In some embodiments, wagering game machines 102 and wagering game servers 106 work together such that a wagering game machine 102 can be operated as a thin, thick, or intermediate client. For example, one or more elements of game play may be controlled by the wagering game machine 102 (client) or the wagering game server 124 (server). Game play elements can include executable game code, lookup tables, configuration files, game outcome, audio or visual representations of the game, game assets, etc. In a thin-client example, the wagering game server 124 can perform functions such as determining game outcome or managing assets, while the wagering game machine 102 can present a graphical representation of such outcome or asset modification to the user (e.g., player). In a thick-client example, the wagering game machines 102 can determine game outcomes and communicate the outcomes to the wagering game server 124 for recording or managing a player's account.

In some embodiments, either the wagering game machines 102 (client) or the wagering game server 124 can provide functionality that is not directly related to game play. For example, account transactions and account rules may be managed centrally (e.g., by the wagering game server 124) or locally (e.g., by the wagering game machine 102). Other functionality not directly related to game play may include power management, presentation of advertising, software or firmware updates, system quality or security checks, etc.

Any of the wagering game network components (e.g., the wagering game machines 102) can include hardware and machine-readable media including instructions for performing the operations described herein. In one embodiment, the wagering game network 100 can include other network devices, such as accounting servers, wide area progressive servers, player tracking servers, and/or other devices suitable for use in connection with embodiments of the invention.

Wagering Game Network Device Architectures

Figure 2:
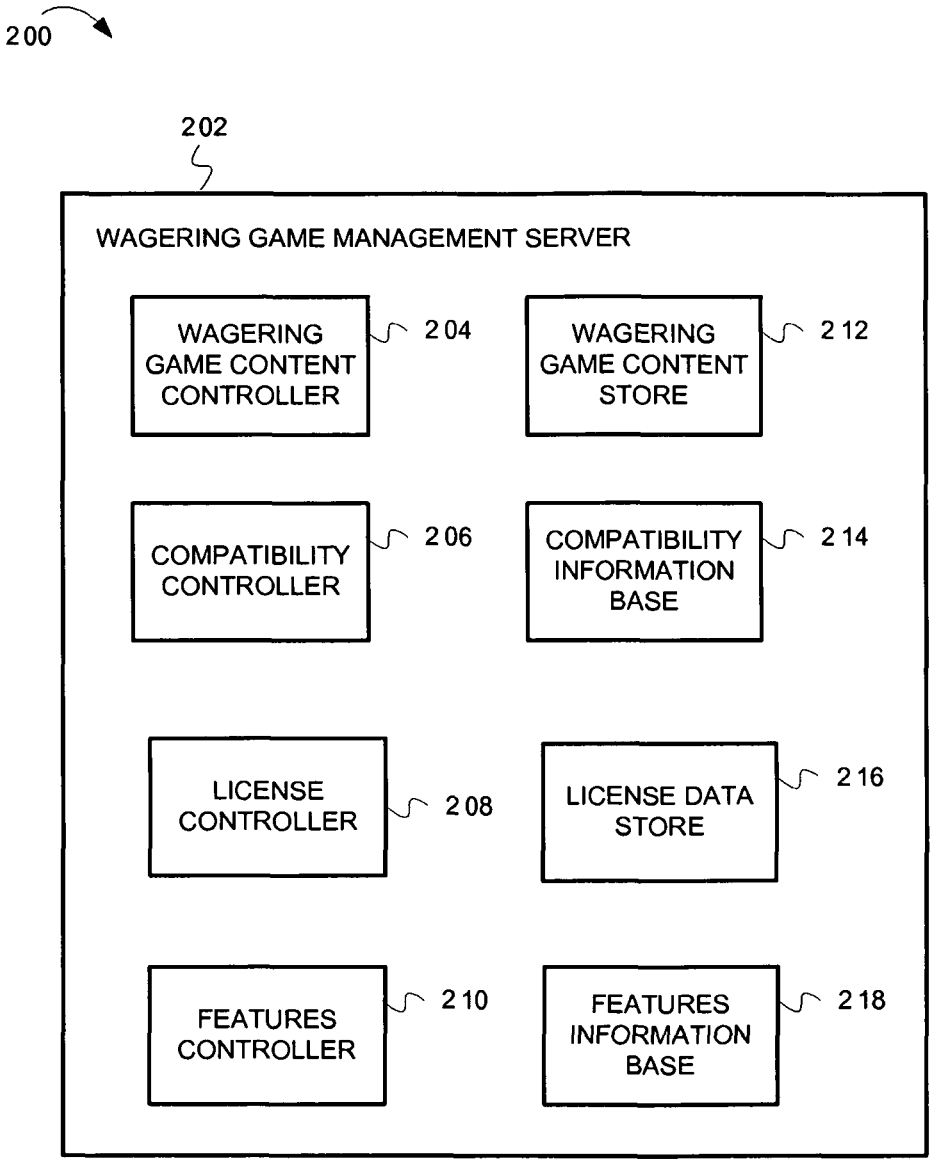
FIG. 2 is a block diagram illustrating a management server architecture, according to some embodiments of the invention.
Figure 3:
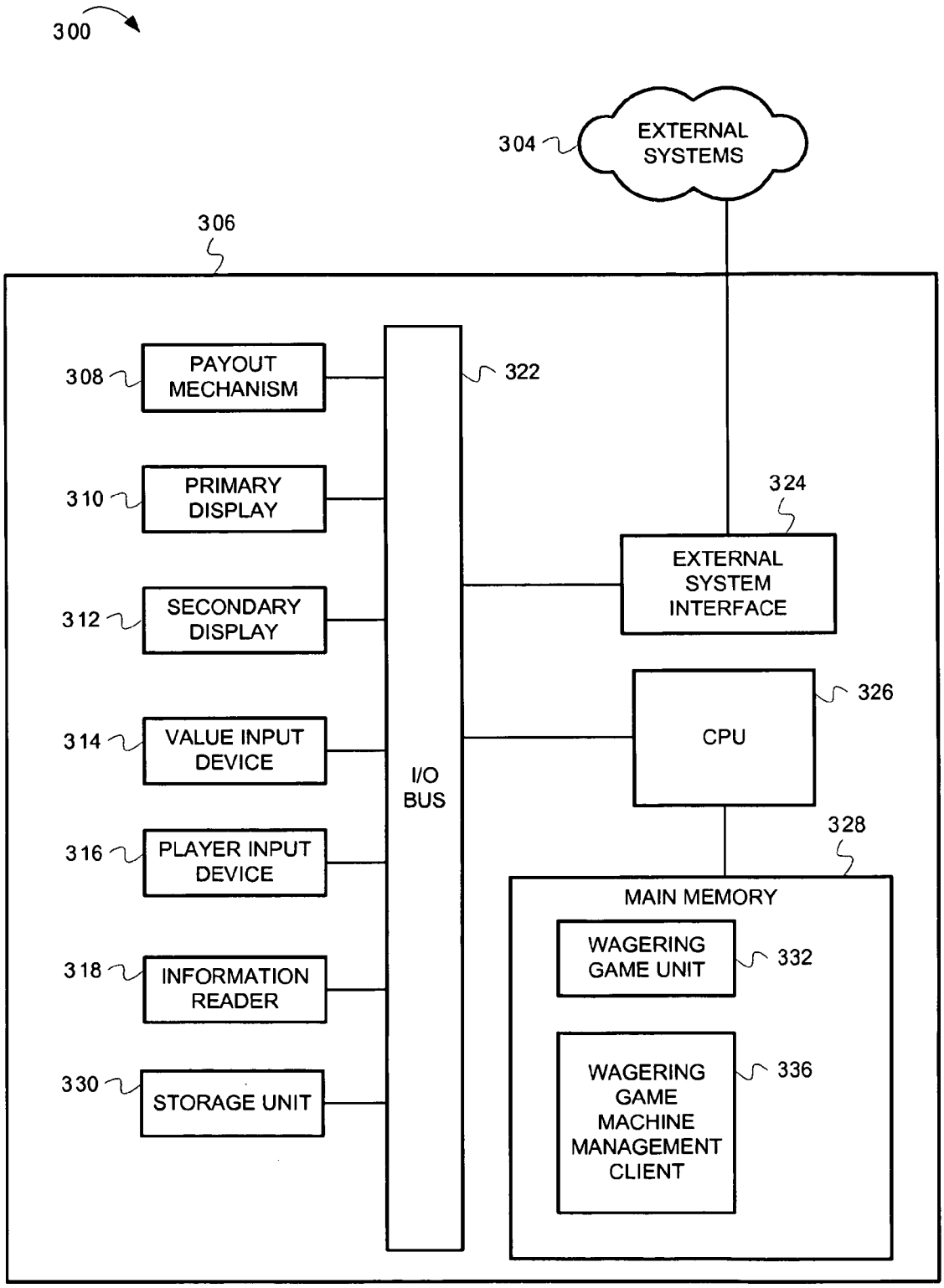
FIG. 3 is a block diagram illustrating a wagering game machine architecture, according to example embodiments of the invention.

This section continues with a discussion of FIGS. 2 & 3. FIG. 2 describes an architecture for management servers and FIG. 3 describes and architecture for wagering game machines.

FIG. 2 is a block diagram illustrating a management server architecture, according to some embodiments of the invention. In FIG. 2, an architecture 200 includes a management server 202. The management server 202 includes a wagering game content controller ("content controller") 204, compatibility controller 206, license controller 208, and features controller 210. Additionally, the management server 202 includes a wagering game content store ("content store") 212, compatibility information base 214, license data store 216, and features information base 218.

In some embodiments, the content controller 204 can receive wagering game content ("content") over a wagering game network and store it in the content store 212. The content controller 204 can also load content onto wagering game machines over a network. In some embodiments, the content controller 204 can work with the compatibility controller 206 to determine whether certain content is compatible with certain wagering game machines. For example, the compatibility controller 206 can determine whether a particular five-reel slots game is compatible with a given wagering game machine. More specifically, for example, the compatibility controller 206 can determine whether the machine has five mechanical reels and/or other equipment needed for presenting the five-reel slots game.

In some embodiments, the license controller 208 can manage license keys and other licensing information needed for keeping wagering game content operable. The license data store 216 can store the license keys and other licensing information.

In some embodiments, the features controller 210 facilitates selection and/or installation of features relating to wagering game machines and/or content. The features controller can store information for managing features in the features information base 218. In some embodiments, features can enable wagering game machines to configure maximum bets, denominations, payout percentages, and more. Additionally, some features can enable wagering games to offer a multiple bonus events, different player languages, and other game options.

This section continues with an example wagering game machine architecture.

FIG. 3 is a block diagram illustrating a wagering game machine architecture, according to example embodiments of the invention. As shown in FIG. 3, the wagering game machine architecture 300 includes a wagering game machine 306, which includes a central processing unit (CPU) 326 connected to main memory 328. The CPU 326 can include any suitable processor, such as an Intel® Pentium processor, Intel® Core 2 Duo processor, AMD Opteronn™ processor, or UltraSPARC processor.

The main memory 328 includes a wagering game machine management client ("management client") 336 and wagering game unit 332. In some embodiments, the management client 336 interacts with a management server 106 and other devices to manage wagering game content, licensing information, and features. The wagering game unit 332 presents wagering games, such as video poker, video black jack, video slots, video lottery, etc., in whole or part. In some embodiments, the wagering game unit 332 presents wagering games using content, features, and/or licensing information acquired and managed by the management client 336.

The CPU 326 is connected to an input/output (I/O) bus 322, which can include any suitable bus technologies, such as an AGTL+ frontside bus and a PCI backside bus. The I/O bus 322 is connected to a payout mechanism 308, primary display 310, secondary display 312, value input device 314, player input device 316, information reader 318, and storage unit 330. The player input device 316 can include the value input device 314 in that the player input device 316 can be used for placing wagers. The I/O bus 322 is also connected to an external system interface 324, which is connected to external systems 304 (e.g., a wagering game network).

In one embodiment, the wagering game machine 306 can include additional peripheral devices and/or more than one of each component shown in FIG. 3. For example, in one embodiment, the wagering game machine 306 can include multiple external system interfaces 324 and/or multiple CPUs 326. In one embodiment, any of the components can be integrated or subdivided. Furthermore, any component of the architectures described herein can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Wagering Game Content, Licensing Information, & Feature Information

As noted above, the various components of a wagering game network can facilitate distribution and licensing of wagering game content. Wagering game content ("content") can include instructions and/or data for conducting wagering games, such as slots, video poker, and video black jack. In some embodiments, content can include program code, audio content, video content, game math, art, operating system code, device drivers, attract mode displays, advertisements, etc. Also, in some embodiments, content can be bundled to include one or more wagering games. For example, a content bundle can include three cascading reels wagering games.

In some embodiments, content is suited only for wagering game machines that have certain components or that are in certain regulatory jurisdictions. For example, content that includes a five-reel mechanical slots game will not operate correctly on machines that do not include five mechanical reels. As another example, content designed for high betting would not be compatible with wagering game machines residing in low betting jurisdictions. The following list shows some components that can affect compatibility between wagering game machines and wagering game content: button panels, special buttons, secondary audio and video devices (a.k.a. top box), operating systems, CPU boards, video cards, primary display types, DRAM sizes, NVRAM sizes, hard disk drives, application programs and other software, etc. Jurisdictional regulations that affect compatibility can include maximum bets, maximum pay lines, and minimum payout percentage.

In some embodiments, content is not usable without certain licensing information. That is, some embodiments require valid license keys (a.k.a., soft licenses) for each content bundle. In some embodiments, a single license key can "activate" (i.e., make usable) content bundles on numerous wagering game machines. License keys can include the following information:

- Part Number—A part number associated with a content bundle.
- Seat Count—The total number of instances a content bundle can be active for a particular licensee.
- Trial Indicator—An indication of whether the content bundle is a trial version.
- Perpetual Indicator—An indication of whether the license has an expiration date.
- Length of Service—The number of days from the first time a license is assigned, after which the license expires.
- Not Before Date—A date. A license key cannot be assigned before the "not before" date.

In addition to distributing and licensing content, the various components of a wagering game network can distribute and manage gaming features. In some embodiments, the gaming features provide additional configurability to wagering game machines and/or content. For example, gaming features can make the following attributes configurable: pay table percentages, player languages, multiple game availability, maximum paylines, maximum bets, denominations, etc. Also, in some embodiments, gaming features enable casino managers to periodically (based on date and time) change a machine's wagering game, payout percentage, and other attributes.

In some embodiments, gaming features enable casino managers to distribute and control "theme sets." Theme sets are content bundles that include a plurality of related wagering games. For example, a theme set can include three cascading reel slots games. Some gaming features can configure wagering game machines to: 1) install content for all wagering games in a theme set, and 2) enable players to select between and play the games of a theme set. In some embodiments, without these gaming features, machines cannot install theme sets. In some regulatory jurisdictions, after the regulatory authority has approved a wagering game, no further regulatory approval is needed to add the wagering game to a theme set. Thus, gaming features and theme sets enable content providers to offer new combinations of content without needing additional regulatory approval.

In some embodiments, casino operators can purchase gaming features as needed. For example, a casino operator can purchase a gaming feature that allows one or more payout percentage options or one or more payline options. The next section describes operations for processing wagering game content, licensing information, and gaming features.

Example Operations

This section describes operations associated with some embodiments of the invention. In the discussion below, the flow diagrams will be described with reference to the block diagrams presented above. In certain embodiments, the operations are performed by executing instructions residing on machine-readable media (e.g., software), while in other embodiments, the operations are performed by hardware and/or other logic (e.g., firmware). In some embodiments, the operations are performed in series, while in other embodiments, one or more of the operations can be performed in parallel. Moreover, some embodiments perform less than all the operations shown in the flow diagrams.

Figure 4:
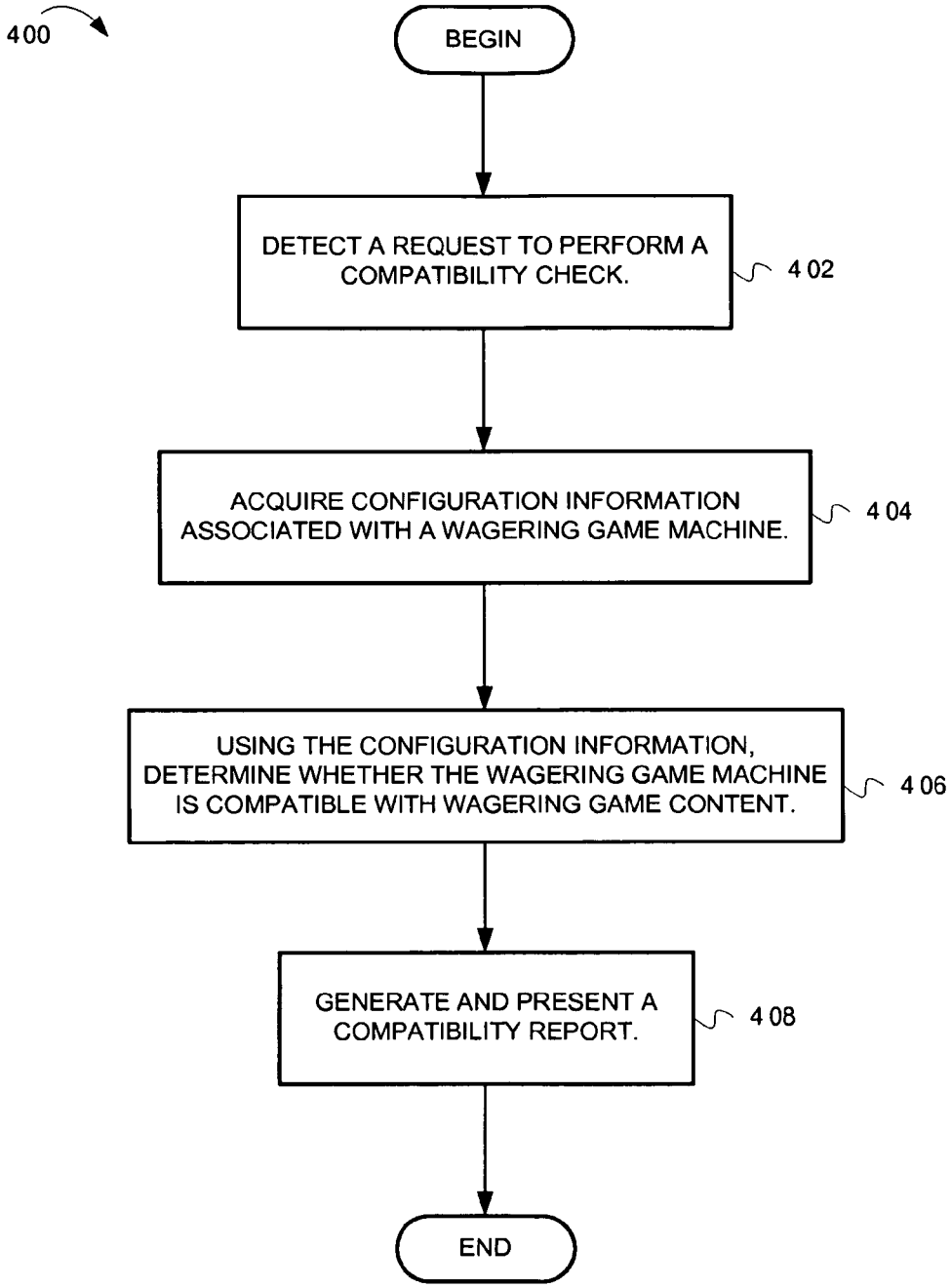
FIG. 4 is a flow diagram illustrating operations for determining whether certain content is compatible with a wagering game machine, according to some embodiments of the invention.
Figure 5:
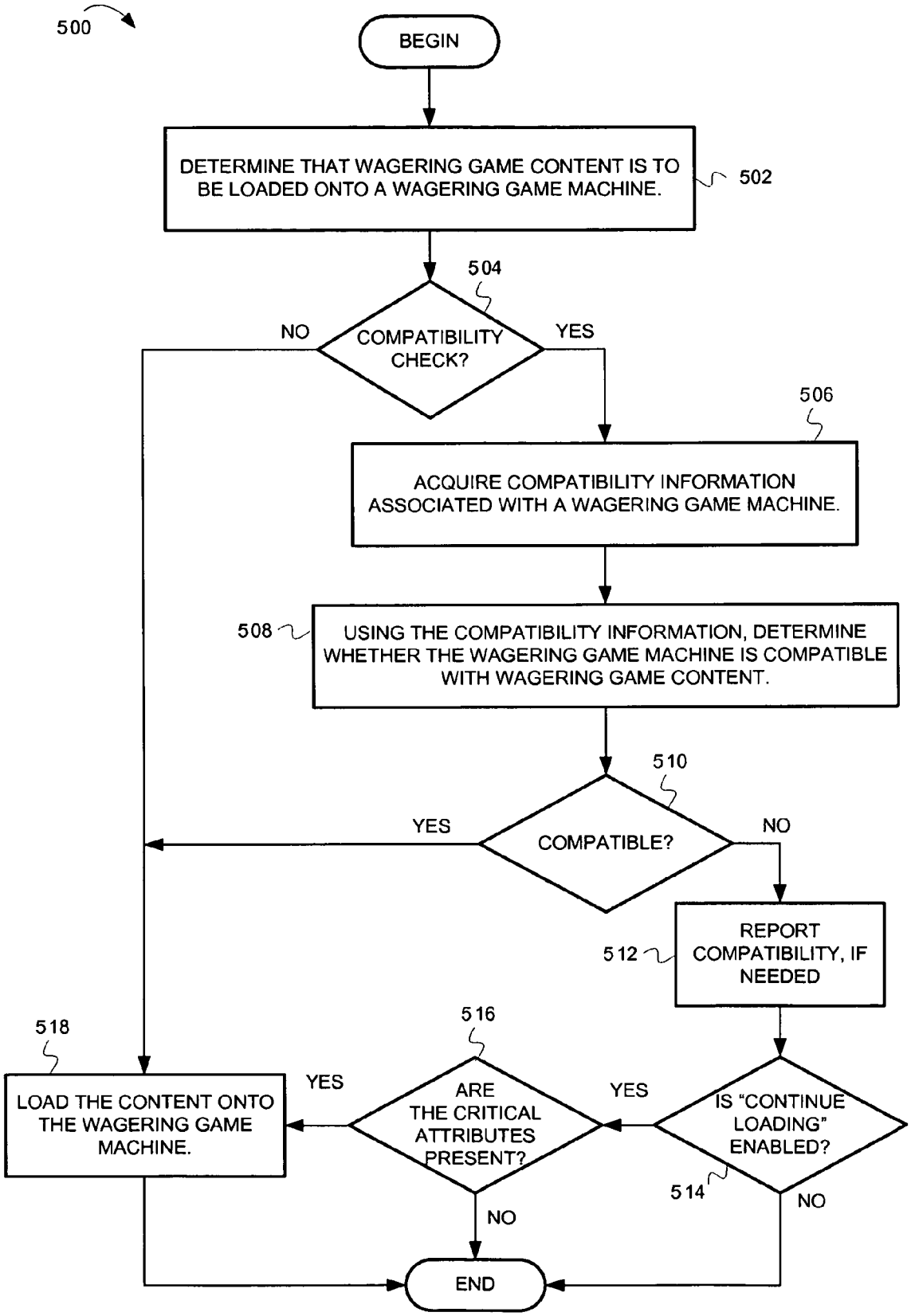
FIG. 5 is a flow diagram illustrating operations for determining compatibility between content and wagering game machines as part of a content distribution process.
Figure 6:
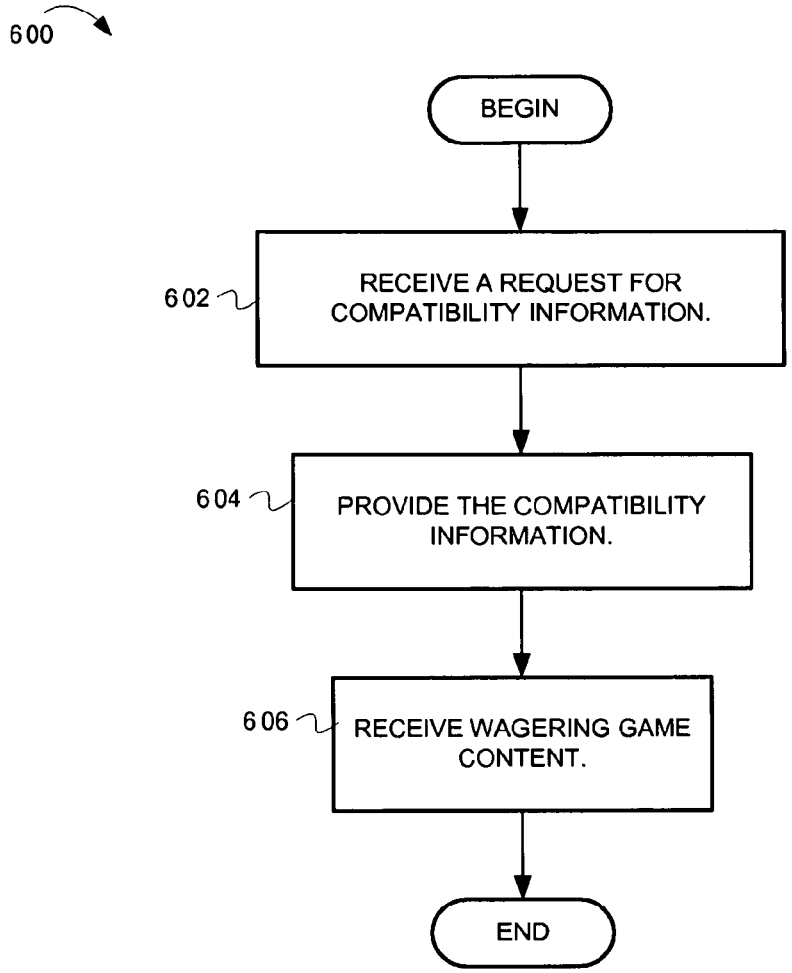
FIG. 6 is a flow diagram illustrating operations for providing information for use in a compatibility determination, according to some embodiments of the invention.
Figure 7:
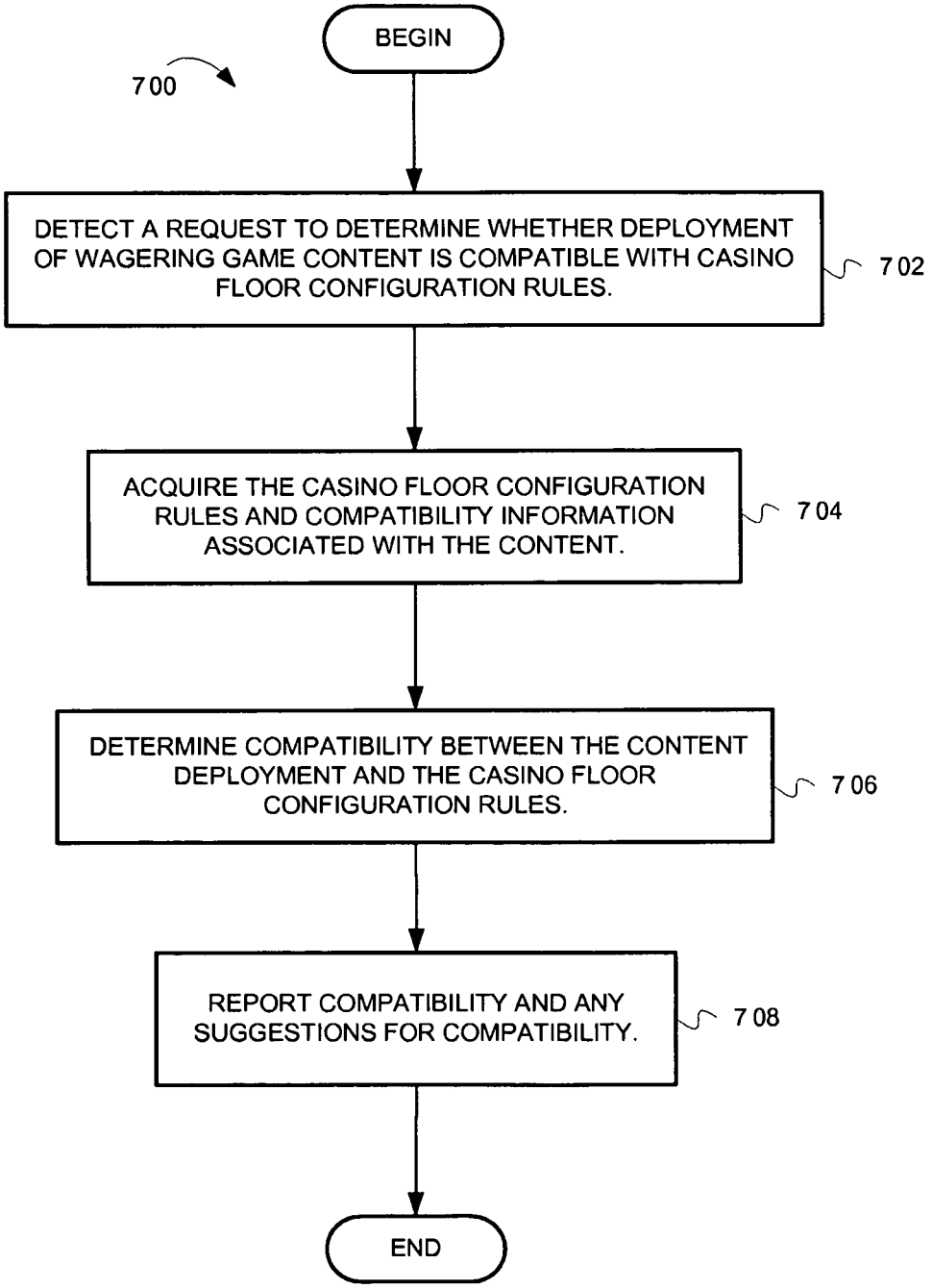
FIG. 7 is a flow diagram illustrating operations for checking compatibility between wagering game content and casino floor configuration rules, according to some embodiments of the invention.
Figure 8:
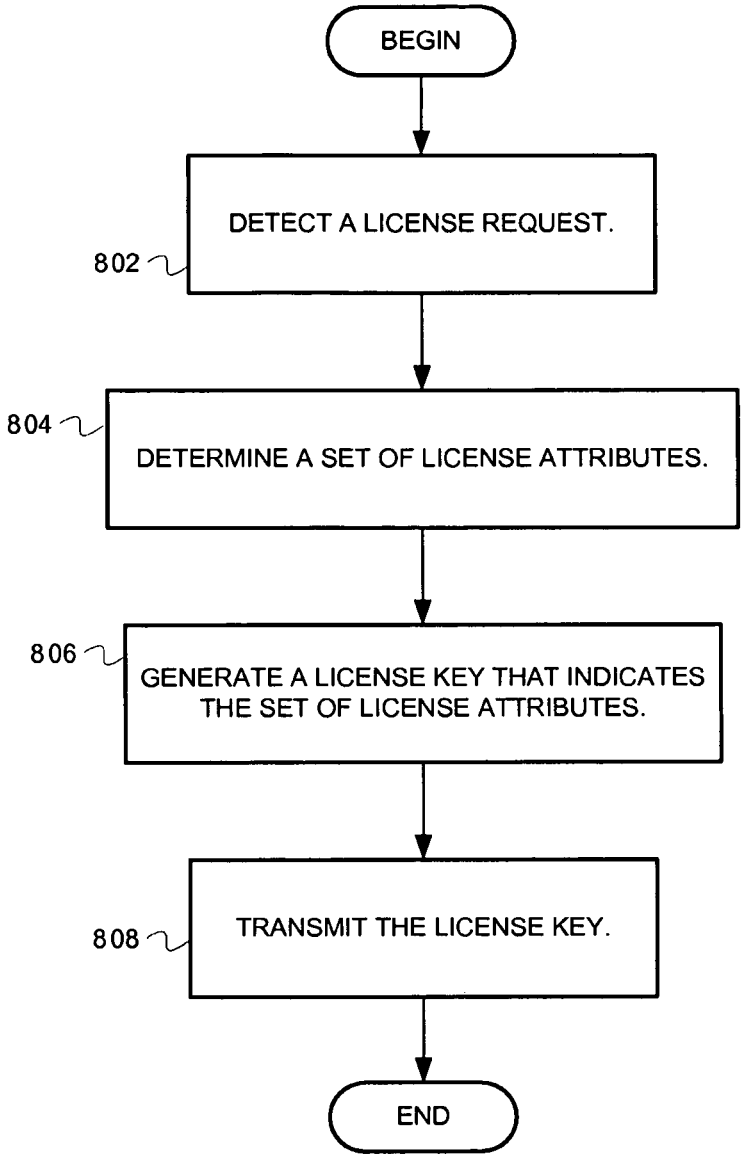
FIG. 8 is a flow diagram illustrating operations for generating and distributing license keys, according to some embodiments of the invention.

The section will discuss FIGS. 4-10. FIGS. 4-6 describe operations for determining whether certain content is compatible with a wagering game machine. FIGS. 7-8 describe operations for processing licensing information and FIGS. 9-10 describe operations for managing gaming features.

Compatibility Operations

Casino managers often try stock their casino floor with wagering game machines and content that maximizes player participation and profits. As some content becomes undesirable, managers can install new content. Because content can have specific compatibility requirements (see discussion above), casino managers may want to know whether a particular content bundle is compatible with certain machines on a casino floor. This section continues with a discussion of operations for determining whether certain content is compatible with certain wagering game machines.

FIG. 4 is a flow diagram illustrating operations for determining whether certain content is compatible with a wagering game machine, according to some embodiments of the invention. The flow 400 begins at block 402.

At block 402, a management server's compatibility controller 206 detects a request to determine compatibility between one or more wagering game machines and certain content. In some embodiments, the compatibility controller 206 can receive the request through a user interface at the management server 106 or at a wagering game machine 102. Alternatively, the compatibility controller 206 can receive the request from another network device (e.g., through a S2S interface), such as another management server. The flow continues at block 404.

At block 404, the compatibility controller 206 acquires compatibility information associated with the wagering game machine(s). In some embodiments, the compatibility controller 206 obtains the compatibility information from the wagering game machine(s). In other embodiments, the compatibility controller 206 obtains the compatibility information from a database (e.g., the compatibility information base 214). As noted above, the compatibility information can indicate regulatory requirement and/or components that are included in a wagering game machine. The flow continues at block 406.

At block 406, using the compatibility information, the management server 106 determines whether the wagering game machine(s) is compatible with the wagering game content. In some embodiments, the management server 106 stores or has access to (e.g., on the content server 122) compatibility information associated with the content. The compatibility information indicates compatibility requirements including what wagering game components are needed for compatibility. The management server 106 can determine whether the content is compatible by comparing the compatibility requirements to the compatibility information. In some embodiments, the management server 106 goes further and determines a list of modifications that will enable support for other, possibly more desirable, content bundles. The flow continues at block 408.

At block 408, the management server 106 generates and presents a compatibility report. In some embodiments, the management server 106 can present report on a wagering game machine 102 or on a terminal connected to the management server 106. In some embodiments, the report indicates a list of modifications necessary for meeting the content's compatibility requirements. For example, the report may indicate that the wagering game machine needs more RAM to be compatible with the content. Also, the report can indicate modifications that will enable support for content bundles that may be more desirable. From block 408, the flow ends.

This section continues with a discussion of operations for checking compatibility during a process for distributing content to wagering game machines on a casino floor.

FIG. 5 is a flow diagram illustrating operations for determining compatibility between content and wagering game machines as part of a content distribution process. The flow 500 begins at block 502.

At block 502, the management server's compatibility controller 206 determines that selected content is to be loaded onto a wagering game machine 102. In some embodiments, the compatibility controller 206 can make this determination based on input received through a graphical user interface on the management server 106 or wagering game machine 102. Alternatively, the compatibility controller 206 can make the determination based on a command from another wagering game network device. The flow continues at block 504.

At block 504, the compatibility controller 206 determines whether it will perform a compatibility check as part of the process for loading content onto the wagering game machine 102. If there will be no compatibility check, the flow continues at block 518. Otherwise, the flow continues at block 506.

At block 506, the management server 106 acquires compatibility information associated with the wagering game machine 102. In some embodiments, the management server 106 obtains the compatibility information from the wagering game machine 102 or from a separate database. The compatibility information can indicate a list of components included in the wagering game machine 102. The flow continues at block 508.

At block 508, using the compatibility information, the compatibility controller 206 determines whether the wagering game machine is compatible with the content. In some embodiments, the management server 106 stores or has access to (e.g., on the content server 122) compatibility information associated with the content. The compatibility information indicates what wagering game components are needed for compatibility. The flow continues at block 510.

At block 510, if the content is not compatible with the wagering game machine 102, the flow continues at block 512. Otherwise, the flow continues at block 518. However, in some embodiments, if the content is incompatible with the wagering game machine 102, the flow ends. That is, in some embodiments, the "no" path from block 510 leads to "end."

At block 512, the compatibility controller 206 reports compatibility, if needed. For example, in some embodiments, an operator can configure the management server 106 to deliver a compatibility report if an incompatibility is detected. The flow continues at block 514.

At block 514, the compatibility controller 206 determines whether the loading process will continue. In some embodiments, the compatibility controller has a "continue loading" option that, when enabled, allows the content distribution process to continue despite some incompatibilities. If the option is disabled, the compatibility controller 206 halts the process. If the content distribution process will continue, the flow continues at block 516. Otherwise, the flow ends.

At block 516, the compatibility controller 206 determines whether critical attributes are present in the wagering game machine 102. In some embodiments, even if some incompatibilities exist, the wagering game machine 102 may be able to use the content, so long as the wagering game machine 102 includes certain critical components. Critical components can be enumerated in the content itself or in a separate database. The critical components can include a specific CPU, specific operating system, and/or specific memory size. Using the compatibility information, the compatibility controller 206 determines whether the wagering game machine 102 includes the necessary critical components. If the critical components are present in the wagering game machine 102, the flow continues at block 518. Otherwise, the flow ends.

At block 518, the management server 106 loads the content onto the wagering game machine 102 over a network. From block 518, the flow ends.

In some instances, even though a wagering game machine is compatible with selected content, some of the machine's resources may not be available for use by the content. For example, if a wagering game machine allows players to select between two games, one game may consume certain resources, while another game consumes other resources. Thus, in addition to determining overall compatibility, some embodiments of the management server can determine a wagering game machine's available resources (e.g., by querying the machine, tracking resource use, etc.).

Because some machines may not have enough available resources to accommodate certain content (e.g., games), some management servers can configure the content to work with reduced resources. Content configurations can include reducing graphics capabilities, sound capabilities, eliminating certain game options, etc. By reducing capabilities or options, games require fewer resources (e.g., RAM, disk space, NVRAM space, processor cycles, etc.). Some content configurations may obviate the need for certain portions of game content, thus reducing the amount of content comprising a wagering game.

The following example describes embodiments in which management servers can configure content. In this example, a multi-game machine has a video blackjack game occupying 60% of its RAM. If a technician were to deploy a slots game to the machine, the slots game would require more than the machine's remaining 40% RAM. In some instances, a management server can configure the wagering game to use reduced graphics. Based on the configuration, the game could run in the machine's remaining 40% RAM. Moreover, because the game is configured to run on reduced graphics, certain portions of the game are not needed. In some instances, the management server would not send the unneeded portions of the wagering game to the machine.

In some instances, management servers can configure content that is already installed and operating on a wagering game machine. For example, continuing from the scenario above, the management server can reconfigure the machine's blackjack game to use less RAM by reducing its graphics capabilities. As a result, the management server can deploy the slots game without reconfiguring it.

While FIGS. 4 & 5 describe compatibility operations typically performed a management server, this section continues with compatibility operations typically performed by a wagering game machine.

FIG. 6 is a flow diagram illustrating operations for providing information for use in a compatibility determination, according to some embodiments of the invention. The flow 600 begins at block 602.

At block 602, a wagering game machine's management client 336 receives a request for compatibility information. The request can originate at the management server 106. The flow continues at block 604.

At block 604, the wagering game machine's management client 336 provides the compatibility information to the requester (e.g., the management server 106). As noted above, the compatibility information can indicate a machine's button panel type, special buttons, secondary audio and video devices (a.k.a. top box), operating system, CPU board, video card, primary display type, DRAM size, NVRAM size, hard disk drive, etc. The compatibility information can also include regulatory information about the jurisdiction in which the wagering game resides. For example, the compatibility information can indicate regulatory requirements for max bets, minimum payout percentage, denomination ranges, etc. In some embodiments, after providing the compatibility information, the wagering game machine 102 can receive and present a compatibility report from the management server 106. The flow continues at block 606.

At block 606, the management client 336 receives content as part of a content loading process. In some embodiments, the management client 336 skips the operation at block 606 because content loading may not be part of a compatibility check (e.g., see FIG. 4). From block 606, the flow ends.

Thus far, this section has described embodiments that determine compatibility between content and wagering game machines. However, even if content is compatible with a given wagering game machine, deploying the content to certain machines may upset casino floor configurations. Casino operators typically know how to maximize profits by placing the various games, themes, denominations, etc. at certain locations on their casino floor. For example, a casino operator may deploy 1¢ games to certain machine banks, while deploying $25 to other banks. Deploying a 1¢ game to a bank of machines configured to play $25 games may upset a strategic floor configuration, thus reducing profits.

Some embodiments of the invention can determine whether content is compatible with a casino's floor configuration rules. The casino floor configuration rules can indicate circumstances in which content is allowed on machines. For example, the rules can consider the following: 1) geographic location of the machine(s), 2) denomination, theme, features, etc. of other machines in proximity (e.g., the same bank, adjacent banks, etc.), 3) date and time, 4) total number of machines with the same or similar denomination, theme, and/or features, and 5) coin-in of certain machines in the casino. While these are a few examples, the casino floor configuration rules can permit or forbid content on machines for any reason. Moreover, the casino floor configuration rules can be in any suitable format, such as in a tabular format, encoded format, tree format, rule-based format, etc.

FIG. 7 is a flow diagram illustrating operations for checking compatibility between wagering game content and casino floor configuration rules, according to some embodiments of the invention. The flow 700 begins at block 702.

At block 702, a management server's compatibility controller 206 detects a request to determine whether deployment of certain wagering game content is compatible with casino floor configuration rules. The request may be received as part of a process by which a technician deploys content to wagering game machines in a casino. For example, after a technician selects content and one or more machines to receive the content, the compatibility controller 206 can automatically perform a compatibility check. Alternatively, a technician may request a compatibility check before going through the process for actually deploying the content. The management server can provide a graphical user interface (e.g., similar to that described vis-à-vis FIGS. 11A & 11B) to facilitate the content deployment and compatibility checking. The flow continues at block 704.

At block 704, the compatibility controller 206 acquires the casino floor configuration rules and compatibility information from the compatibility information base 214. In some instances, the compatibility controller 206 can acquire the rules and compatibility information from other components. The flow continues at block 706.

At block 706, the compatibility controller 206 determines whether deploying the wagering game content comports with casino floor configuration rules. The compatibility controller 206 can inspect the rules and determines whether deploying given content to a particular machine is permitted. In some instances, the compatibility controller 206 includes a rule-based system including the casino floor configuration rules. After receiving parameters about the content deployment, the rule-based system can indicate whether the content deployment comports with the configuration rules. The flow continues at block 708.

At block 708, the compatibility controller 206 indicates whether the content deployment is compatible with the casino floor configuration rules. For example, the compatibility controller 206 can present graphics indicating the content deployment is compatible or incompatible with configuration rules. If the compatibility check is part of a process for deploying content, the compatibility controller 206 can block the deployment. In some instances, the compatibility controller 206 can present graphics suggesting alternative content that would be compatible with the casino floor configuration rules. From block 708, the flow ends.

The discussion will now turn to operations for managing and distributing licensing information.

Licensing Operations

As described above, the content server and management server can distribute content over a network. In some embodiments, the content may not be usable without a valid license key. The following discussion presents operations for creating, distributing, and installing license keys.

FIG. 8 is a flow diagram illustrating operations for generating and distributing license keys, according to some embodiments of the invention. In some embodiments, the license keys can be distributed before content is loaded onto a wagering game machine. Alternatively, license keys can be distributed as part of a process for enabling content that has been loaded on a wagering game machine. The flow 800 begins at block 802.

At block 802, the license server 120 detects a license request. The license server 120 can receive the license request from a wagering game network component, such as the management server 106 or wagering game machine 102. Alternatively, the license server 120 can receive the request through a graphical user interface provided by the license server 120. In some embodiments, the license request can include licensing information that indicates a desired content bundle, seat count, license term, etc. The flow continues at block 804.

At block 804, the license server 120 determines a set of license attributes. The license attributes can indicate a content bundle, seat count, license term, length of service, etc. In some embodiments, the license server 120 makes this determination using the licensing information received at block 802. The flow continues at block 806.

At block 806, a license server 120 generates a license key that indicates a set of license attributes. The license key can include the following information: part number, seat count, trial indicator, perpetual indicator, length of service, not before date, etc. In some embodiments, license server 120 digitally signs the license key. The flow continues at block 808.

At block 808, the license server 120 transmits the license key. In some embodiments, the license server 120 e-mails the license key to a management server 106. In other embodiments, the license server 120 prints the license key on paper, so it can be mailed through the traditional mail system (e.g., the U.S. postal service).

Thus far, the discussion has focused on operations for distributing "soft licenses" over a network. However, in some embodiments, the license controller 208 can also track "hard licenses." Content is associated with a hard license if a media device (e.g., DVD, Flash RAM device, etc.) must be present to run the content. Hard licensed content can be moved between wagering game machines, so when a media device is removed from a wagering game machine, the machine's content will not run without the media device. In some embodiments, a license controller 208 can track hard licenses in a wagering game network. For example, when wagering game machines install and use hard licensed content, they can notify the license controller 208. As a result, the license controller 208 has a record of which wagering game machines include hard licenses and which include soft licenses.

This section continues with operations for receiving and processing license keys.

Figure 9:
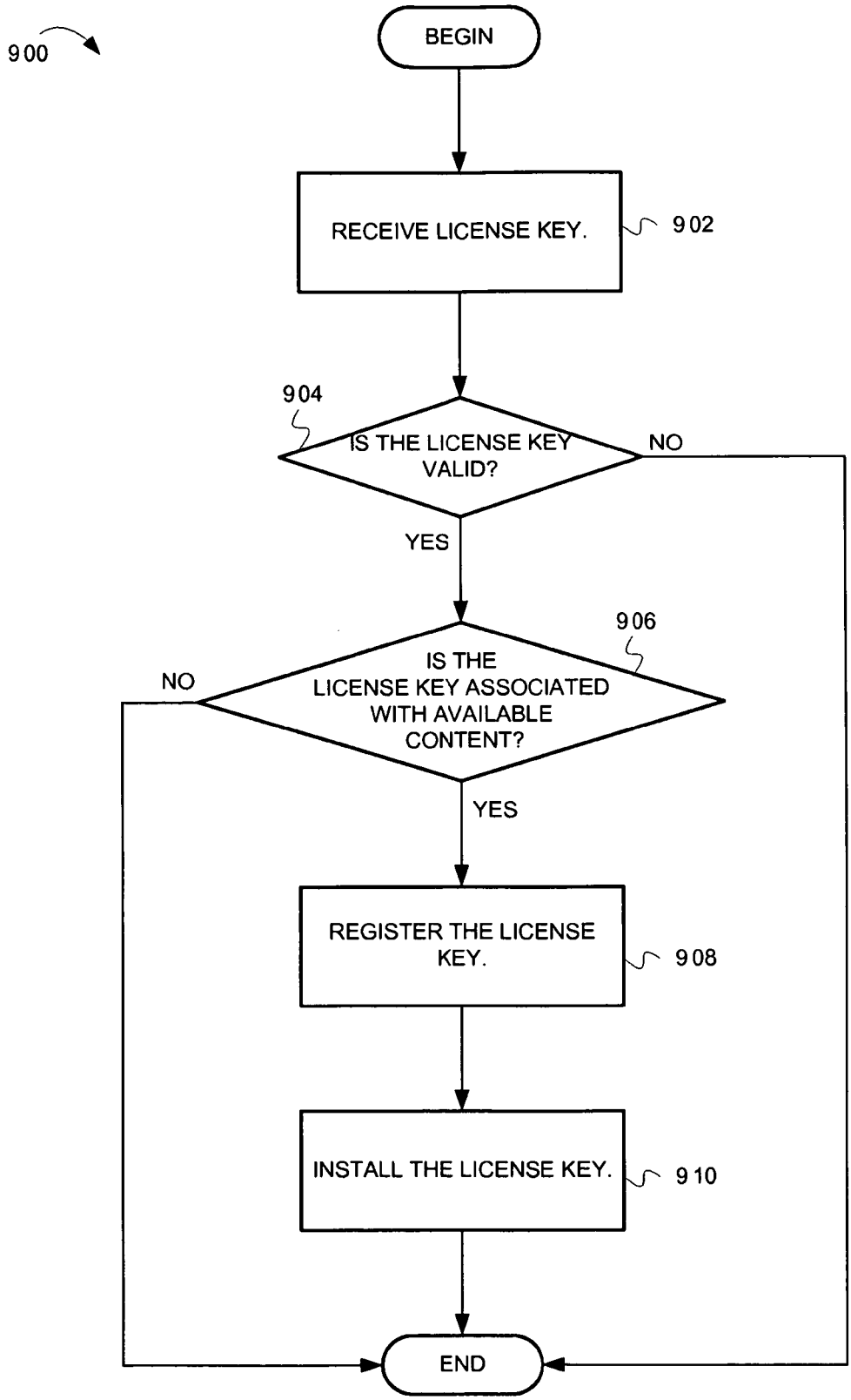
FIG. 9 is a flow diagram illustrating operations for receiving and installing a licensing key, according to some embodiments of the invention.

FIG. 9 is a flow diagram illustrating operations for receiving and installing a licensing key, according to some embodiments of the invention. The flow 900 begins at block 902.

At block 902, a management server's license controller 208 receives a license key from a license server 120. In some embodiments, instead of receiving the license key from the license server 120 via a network, the license controller 208 receives a license key as character string entered into the management server's graphical user interface. The flow continues at block 904.

At block 904, the license controller 208 determines whether the license key is valid. In some embodiments, the license controller 208 can make this determination by checking the license key's digital signature, checking the license key's checksum, and/or checking the license key's expiration date. If the license key is valid, the flow continues at block 906. Otherwise, the flow ends.

At block 906, the license controller 208 determines whether a license key is associated with available content. For example, the license key is associated with available content if the key is associated with content stored in the content store 212 or with content loaded onto a wagering game machine 102. If a license key is associated with available content, the flow continues at block 908. Otherwise, the flow ends.

At block 908, the license controller 208 registers a license key with the license server 120. The license controller 208 can register the license key by sending an acknowledgment to the license server 120. In turn, the license server 120 can record the acknowledgment. The flow continues at block 910.

At block 910, the license controller 208 installs the license key. The license controller 208 can install a license key by storing the license key in the license data store 216 and creating an association between the license key and a particular content bundle. From block 910, the flow ends.

Gaming Features

As described above, content providers can distribute gaming features that affect content and wagering game machines. For example, content providers can distribute gaming features that enable casino managers to change a wagering game machine's denominations, payout percentage, number of wagering game types, and other attributes. Similarly, content providers can also distribute gaming features that enable casino managers to utilize additional functionality included in certain content. In the following discussion FIG. 9 describes operations for distributing gaming features in a wagering game network, while FIG. 10 shows an interface through which casino managers can select gaming features.

Figure 10:
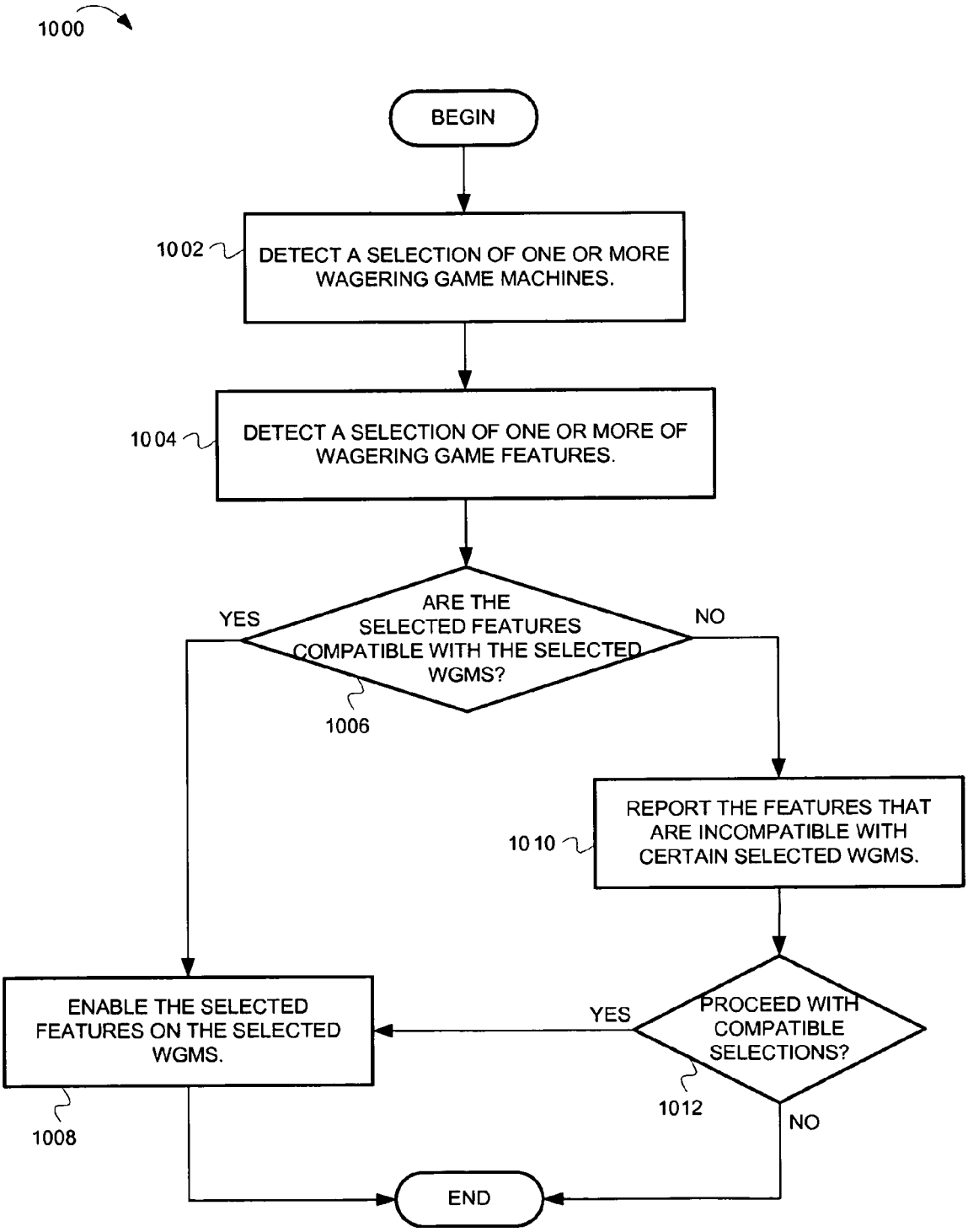
FIG. 10 is a flow diagram illustrating operations for distributing gaming features, according to some embodiments of the invention.

FIG. 10 is a flow diagram illustrating operations for distributing gaming features, according to some embodiments of the invention. The flow 1000 begins at block 1002.

Figure 11A:
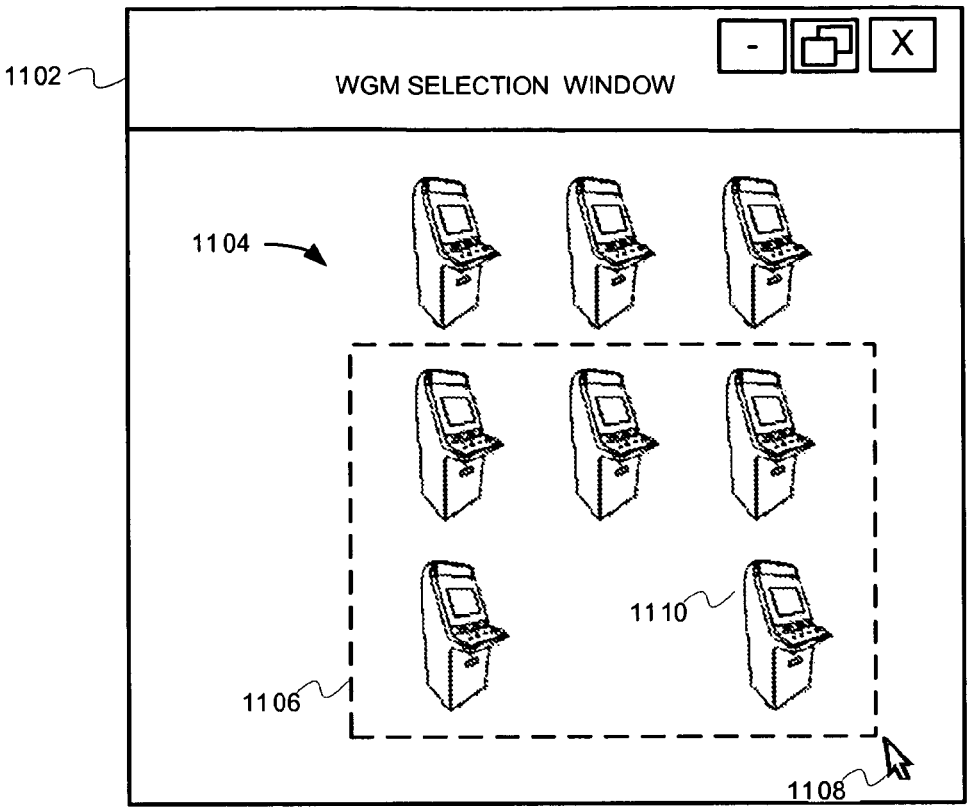
FIG. 11A shows a graphical user interface through which an operator can select wagering game machines.

At block 1002, a management server's features controller 210 detects a selection of one or more wagering game machines. The features controller 210 can detect the selection through a graphical user interface. FIG. 11A shows a graphical user interface through which an operator can select wagering game machines. In FIG. 11A, the wagering game selection window 1102 includes a casino floor map 1104. An operator can select wagering game machines (e.g., a single machine, a bank of machines, etc.) by using the pointer 1108 to create a selection area 1106 around wagering game machines 1110 in the map 1104. Referring back to FIG. 10, the flow 1000 continues at block 1004.

Figure 11B:
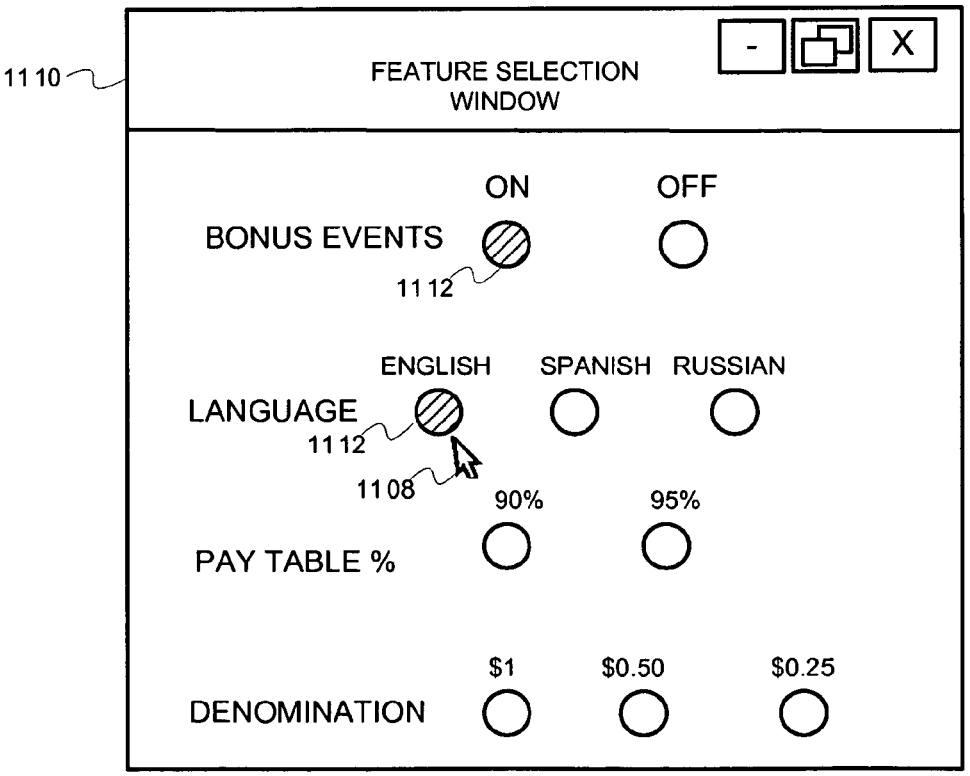
FIG. 11B shows a graphical user interface through which an operator can select gaming features.

At block 1004, the features controller 210 detects a selection of one or more gaming features. In some embodiments, the features controller 210 detects the selection through a graphical user interface. FIG. 11B shows a graphical user interface through which an operator can select gaming features. In FIG. 11B, the feature selection window 1110 enumerates a number of selectable gaming features including bonus events, language, pay table percentage, and denominations. Of the gaming features shown in the window 1110, the bonus events feature configures content (e.g., wagering games), while the other gaming features configure attributes of a wagering game machine. For each selectable gaming feature, an operator can use the pointer 1108 to select feature options. As indicated by the shaded radio buttons 1112, the selected gaming features will turn-on bonus events and enable English as the featured language. Although not shown, the gaming features can also include theme-set-related features that enable theme sets on the selected machines. Referring back to FIG. 10, the flow 1000 continues at block 1006.

At block 1006, the features controller 210 determines whether the selected gaming features are compatible with the selected wagering game machines. In some embodiments, the features controller 210 determines whether the components and content on each of the selected wagering game machines can support the selected gaming features. If the gaming features are compatible, the flow continues at block 1008. Otherwise, the flow continues at block 1010.

At block 1008, the features controller 210 enables the selected gaming features on the selected wagering game machines. In some embodiments, the features controller 210 enables the select gaming features by sending messages and/or additional content to the selected wagering game machines. In some embodiments, when the flow 1000 enters block 1008 from block 1012, the features controller 210 enables certain gaming features on certain machines (see discussion of block 1012). From block 1008, the flow ends.

As noted, if the selected gaming features are not compatible with the select wagering game machines, the flow continues at block 1010. At block 1010, the features controller 210 reports (e.g., in a GUI or via email) a list of gaming features that are incompatible with the selected wagering game machines. The flow continues at block 1012.

At block 1012, the features controller 210 determines whether it will proceed with those gaming features that are compatible with the selected wagering game machines. In some embodiments, if one of the selected wagering game machines is incompatible with the selected features, the features controller 210 will not enable the selected features on any of the selected machines. Alternatively, the features controller 210 can enable the selected features on the selected machines that are compatible with the selected features. In some embodiments, the features controller 210 makes this determination based on pre-selected settings and/or casino manager input. If the gaming features controller 210 will proceed, the flow continues at block 1008. Otherwise, the flow ends.

While the embodiment in FIG. 10 checks compatibility after the gaming features are selected, other embodiments check compatibility before the features are selected. Thus, in some embodiments, the feature selection window 1110 only shows gaming features that are compatible with the selected wagering game machines. In other embodiments, incompatible features appear in the selection window 1110, but they are not selectable (e.g., there is no associated radio button 1112).

Example Wagering Game Machines

Figure 12:
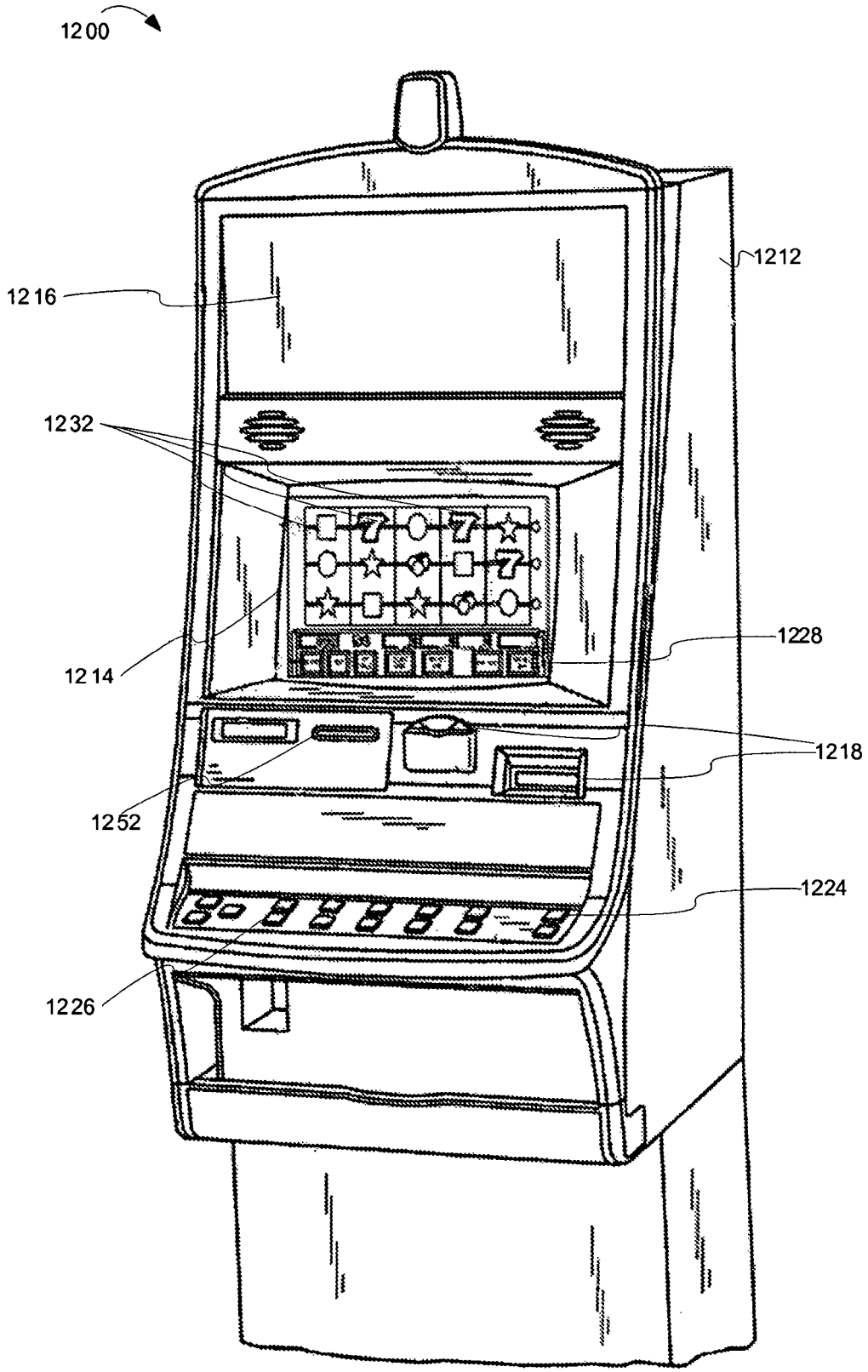
FIG. 12 is a perspective view of a wagering game machine, according to example embodiments of the invention.

FIG. 12 is a perspective view of a wagering game machine, according to example embodiments of the invention. Referring to FIG. 12, a wagering game machine 1200 is used in gaming establishments, such as casinos. According to embodiments, the wagering game machine 1200 can be any type of wagering game machine and can have varying structures and methods of operation. For example, the wagering game machine 1200 can be an electromechanical wagering game machine configured to play mechanical slots, or it can be an electronic wagering game machine configured to play video casino games, such as blackjack, slots, keno, poker, blackjack, roulette, etc.

The wagering game machine 1200 comprises a housing 1212 and includes input devices, including value input devices 1218 and a player input device 1224. For output, the wagering game machine 1200 includes a primary display 1214 for displaying information about a basic wagering game. The primary display 1214 can also display information about a bonus wagering game and a progressive wagering game. The wagering game machine 1200 also includes a secondary display 1216 for displaying wagering game events, wagering game outcomes, and/or signage information. While some components of the wagering game machine 1200 are described herein, numerous other elements can exist and can be used in any number or combination to create varying forms of the wagering game machine 1200.

The value input devices 1218 can take any suitable form and can be located on the front of the housing 1212. The value input devices 1218 can receive currency and/or credits inserted by a player. The value input devices 1218 can include coin acceptors for receiving coin currency and bill acceptors for receiving paper currency. Furthermore, the value input devices 1218 can include ticket readers or barcode scanners for reading information stored on vouchers, cards, or other tangible portable storage devices. The vouchers or cards can authorize access to central accounts, which can transfer money to the wagering game machine 1200.

The player input device 1224 comprises a plurality of push buttons on a button panel 1226 for operating the wagering game machine 1200. In addition, or alternatively, the player input device 1224 can comprise a touch screen 1228 mounted over the primary display 1214 and/or secondary display 1216.

The various components of the wagering game machine 1200 can be connected directly to, or contained within, the housing 1212. Alternatively, some of the wagering game machine's components can be located outside of the housing 1212, while being communicatively coupled with the wagering game machine 1200 using any suitable wired or wireless communication technology.

The operation of the basic wagering game can be displayed to the player on the primary display 1214. The primary display 1214 can also display a bonus game associated with the basic wagering game. The primary display 1214 can include a cathode ray tube (CRT), a high resolution liquid crystal display (LCD), a plasma display, light emitting diodes (LEDs), or any other type of display suitable for use in the wagering game machine 1200. Alternatively, the primary display 1214 can include a number of mechanical reels to display the outcome. In FIG. 12, the wagering game machine 1200 is an "upright" version in which the primary display 1214 is oriented vertically relative to the player. Alternatively, the wagering game machine can be a "slant-top" version in which the primary display 1214 is slanted at about a thirty-degree angle toward the player of the wagering game machine 1200. In yet another embodiment, the wagering game machine 1200 can exhibit any suitable form factor, such as a free standing model, bartop model, mobile handheld model, or workstation console model.

A player begins playing a basic wagering game by making a wager via the value input device 1218. The player can initiate play by using the player input device's buttons or touch screen 1228. The basic game can include arranging a plurality of symbols along a payline 1232, which indicates one or more outcomes of the basic game. Such outcomes can be randomly selected in response to player input. At least one of the outcomes, which can include any variation or combination of symbols, can trigger a bonus game.

In some embodiments, the wagering game machine 1200 can also include an information reader 1252, which can include a card reader, ticket reader, bar code scanner, RFID transceiver, or computer readable storage medium interface. In some embodiments, the information reader 1252 can be used to award complimentary services, restore game assets, track player habits, etc.

General

This detailed description describes specific examples in the drawings and illustrations. These examples are described in sufficient detail to enable those skilled in the art to practice the inventive subject matter, and serve to illustrate how the inventive subject matter can be applied to various embodiments. Other embodiments are included within the inventive subject matter, as logical, mechanical, electrical, and other changes can be made to the example embodiments described herein. Features or limitations of various embodiments, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method for delivering wagering game content to wagering game machines, the method comprising:

detecting, by a computing device, a selection of wagering game content and a wagering game machine;

acquiring, by the computing device over a network, compatibility information associated with the wagering game machine, wherein the compatibility information indicates a casino floor location of the wagering game machine;

determining, by the computing device, configuration information about other wagering game machines near the casino floor location;

comparing, by the computing device, the configuration information about other wagering game machines near the casino floor location and the compatibility information;

determining, based on the comparing, that the wagering game content is one of compatible with the wagering game machine and incompatible with the wagering game machine;

loading, if the wagering game content is compatible with the wagering game machine, the wagering game content onto the wagering game machine over the network; and reporting, if the wagering game content is incompatible with the wagering game machine, incompatibilities between the wagering game content and the wagering game machine.

2. The method of claim 1 further comprising:

generating, if the wagering game content is compatible with the wagering game machine, a report indicating that the wagering game content is compatible with the wagering game machine.

3. The method of claim 1, wherein the compatibility information further includes at least one of button panels, special buttons, audio devices, video devices, operating systems, CPU boards, DRAM, NVRAM, hard disk drives, and application software associated with the wagering game machine.

4. The method of claim 1, wherein the compatibility information is acquired from the wagering game machine over the network.

5. The method of claim 1, wherein the compatibility information is acquired over the network from a database separate from the wagering game machine.

6. An apparatus comprising:

one or more processors; and a memory device including instructions which, when executed by at least one of the one or more processors, cause the at least one of the one or more processors to perform operations comprising:

determining a floor location of a wagering game machine;

determining configuration information about other wagering game machines near the floor location of the wagering game machine;

comparing the configuration information about other wagering game machines near the floor location of the wagering game machine and the floor location for the wagering game machine;

determining, based on the comparing that the wagering game content is compatible with the wagering game machine;

loading, after the determining that the wagering game content is compatible with the wagering game machine, the wagering game content onto the wagering game machine over a network;

receiving licensing information; and using the licensing information to activate the wagering game content on the wagering game machine.

7. The apparatus of claim 6, wherein the licensing information is received over the network.

8. The apparatus of claim 6, wherein wagering game content is not usable without the activation via the licensing information.

9. The apparatus of claim 6, the operations further comprising:

distributing gaming features to the wagering game machine over the network, wherein the gaming features allow configuration of the wagering game machine and the wagering game content.

10. The apparatus of claim 9, wherein the gaming features allow configuration of one or more attributes of the wagering game machine, wherein the attributes include one or more of denominations, maximum bets, maximum paylines, number of wagering games, and payout percentage.

11. The apparatus of claim 6, wherein the licensing information includes a license key including one or more of a part number, seat count, trial indicator, perpetual indicator, length of service, and not before date.

12. A wagering game machine comprising:

a network interface configured to facilitate communications over a network;

a wagering game machine management client configured to, control receipt of wagering game content and licensing information through the network interface, initiate transmission of compatibility information through the network interface, wherein the compatibility information identifies a casino floor location of the wagering game machine and indicates configuration information of wagering game machines near the casino floor location, and wherein the compatibility information is compared to the configuration information of the wagering game machines near the casino floor location to determine whether the wagering game content is allowable on the wagering game machine; and a wagering game unit configured to present wagering games based on the wagering game content and licensing information.

13. The wagering game machine of claim 12, wherein the wagering game machine management client is further configured to receive gaming features, wherein the gaming features enable configuration of the wagering game content and the wagering game machine.

14. The wagering game machine of claim 12, wherein the wagering game machine management client is further configured to receive gaming features, wherein the gaming features enable configuration of attributes of the wagering game machine, wherein the attributes include one or more of denominations, maximum bets, maximum paylines, number of wagering games, and payout percentage.

15. The wagering game machine of claim 12, wherein the wagering game machine management client is further configured to receive gaming features, wherein the gaming features enable the wagering game machine to switch between a plurality of wagering games to change paylines, denominations, maximum bets, maximum paylines, number of wagering games, and payout percentage based on date and time.

16. The wagering game machine of claim 12, wherein the licensing information includes one or more of a part number, seat count, trial indicator, perpetual indicator, length of service, and a not-before date.

17. A method comprising:

detecting, by one or more computing devices, a request to transmit wagering game content to one of a plurality of wagering game machines on a casino floor, wherein the wagering game content includes one or more of features and denominations, and wherein the one of the plurality of wagering game machines resides at a geographic location on the casino floor;

accessing, by the one or more computing devices, casino floor configuration rules indicating geographic locations on the casino floor at which use of wagering game content including the one or more of features and denominations is allowed;

comparing the geographic location on the casino floor with the casino floor configuration rules;

determining, based on the comparing, that transmission of the wagering game content to the one of the plurality of wagering game machines is not allowed; and presenting, on a display device, graphics indicating that transmission of the wagering game content to the one of the plurality of wagering game machines is not allowed.

18. The method of claim 17 further comprising:

presenting, on the display device, a list of alternative wagering game content that is allowable on the one of the plurality of wagering game machines.

19. The method of claim 17 further comprising:

blocking, by the one or more computing devices, transmission of the wagering game content.

20. The method of claim 17 wherein the wagering game content includes a wagering game, and wherein the one or more features and denominations are associated with the wagering game.

* * * * *